US005676076A

United States Patent [19]

Burke

[11] Patent Number: 5,676,076

[45] Date of Patent: Oct. 14, 1997

[54] THREAD CONDITIONING DEVICE

[76] Inventor: Pamela Bryant Burke, 7031 Mason Dells, Dallas, Tex. 75230

[21] Appl. No.: 622,089

[22] Filed: Mar. 26, 1996

Related U.S. Application Data

[63] Continuation-in-part of Ser. No. 459,808, Jun. 2, 1995, abandoned.

[51] Int. Cl.[6] ..... D05B 71/00

[52] U.S. Cl. ..... 112/256

[58] Field of Search ..... 112/256; 57/295; 28/217; 68/200; 118/234, 264, 420, DIG. 18, DIG. 19, DIG. 20

[56] References Cited

U.S. PATENT DOCUMENTS

| | | | |
|---|---|---|---|
| 909,608 | 1/1909 | Kershner . | |
| 1,703,781 | 2/1929 | Rubel . | |
| 1,766,954 | 6/1930 | Scholler . | |
| 2,183,659 | 12/1939 | Stein . | |
| 2,781,021 | 2/1957 | Schmitz | 68/200 X |
| 2,885,984 | 5/1959 | Earnhart . | |
| 2,910,026 | 10/1959 | Ajouelo . | |
| 3,073,000 | 1/1963 | Gonsalves et al. | 68/200 X |
| 3,393,660 | 7/1968 | Walden . | |
| 4,345,542 | 8/1982 | Hauner . | |
| 4,463,652 | 8/1984 | Monget et al. . | |
| 4,875,348 | 10/1989 | Kinnebrew et al. . | |
| 5,165,993 | 11/1992 | van Anholt et al. . | |

FOREIGN PATENT DOCUMENTS

| | | |
|---|---|---|
| 520993 | 2/1921 | France . |
| 1059752 | 6/1959 | Germany . |
| 543151 | 3/1956 | Italy . |
| 0621155 | 1/1981 | Sweden . |
| 784472 | 10/1957 | United Kingdom . |

*Primary Examiner*—Paul C. Lewis
*Attorney, Agent, or Firm*—John L. Sigalos

[57] ABSTRACT

An improved thread conditioning device for use as an accessory to conventional sewing machines. Included are a rectangular baseplate with a pair of upstanding projections. One of the projections near the rear portion of the plate extends upwardly and at its extremity has two essentially right angle bands so as to adapt it for swivelably supporting a small platform having two parallel major surfaces on one of which there is fixed a specially shaped adapter having a plurality of different sized cylindrical recesses for receiving any one of a corresponding plurality of different diameter supports. On the other major surface there is affixed a conditioning pad with a pair of thread guides to guide thread into contact with and past an exposed surface of the conditioning pad for use in tensioning and/or lubricating thread. Optimally included are an additional spool holder mounted on a turn-table and a lubricant reservoir for supplying lubricant to the pad.

20 Claims, 1 Drawing Sheet

THREAD CONDITIONING DEVICE

CROSS-REFERENCE TO RELATED APPLICATIONS

The instant application is a Continuation-in-Part of U.S. patent application Ser. No. 08/459,808, filed Jun. 2, 1995 now abandoned, the entirety of which is specifically incorporated herein by reference.

BACKGROUND OF THE INVENTION

This invention relates to thread conditioning devices and more particularly to such devices that are adapted for tensioning and/or lubricating metallic or non-metallic sewing thread.

As has long been known to those skilled in the art, certain types of thread require modest tensioning in order to feed optimally into sewing machines and the like. In addition, it has been known that certain types of metallic or metallized and specialty sewing threads require lubrication in order to avoid being damaged or broken when used in sewing machines or wound on spools. A variety of proposals have heretofore been made for tensioning fiber threads or for lubricating metallic/specialty threads to facilitate usage. Examples of such proposals are those set forth in the following Patents: U.S. Pat. Nos. 1,703,781 granted to C. F. Rubel Feb. 26, 1929; 1,766,954 granted to F. C. Scholler Jun. 24, 1930; 2,183,659 granted to Elias Stein Dec. 19, 1939; 2,885,984 granted to W. C. Earnhart May 12, 1959; 4,463,652 granted to Monget et al Aug. 7, 1984; and 5,165,993 granted to Van Anholt et al Nov. 24, 1992. Other examples are those of Swiss Patent 621,155; Italian Patent 543,151; British Patent 784,472; French Patent 520,993; and German Auslegeschrift 1,059,752.

In general the foregoing proposals were centered around attachments to conventional sewing machines. Others featured separated vats, reservoirs and the like for passing yarn or thread through liquid lubricants. In addition, there have been a variety of proposals for tensioning fiber (e.g., yarn) threads. However, there has continued to be a need for a simple and inexpensive accessory that does not require attachment to a machine and which can either frictionally tension or lubricate threads without passing the thread through a reservoir of the lubricant itself.

BRIEF SUMMARY OF THE INVENTION

The improved thread conditioning device according to the invention hereof includes a simple and inexpensive combination of a relatively heavy rectangular base on which there are mounted at predetermined spaced locations, a pair of rods each having at least one bend. A first one of the rods is bent at a right angle after projecting upwardly from the base by a sufficient distance to provide clearance for mounting of one or more spools of thread, the diameter of the first rod being smaller than the diameter of conventional apertures through the center of conventional spools, thus providing a relatively loose fit to facilitate rotation of the spool(s) when in use, and discharge of thread therefrom.

The second one of the rods is bent twice at right angles so as to form a total of three sections. The first bend is made after more than half (the majority) of the second rod has projected upwardly essentially at right angles to the upper surface of the base so as to form a first section and a second section. After a predetermined length for the second section, the remainder of the second rod is bent again essentially at a right angle to form a third section at right angles to both the first and section sections. Thus, the first section of the second rod extends essentially vertically from the major plane of the base and the remaining two sections are essentially parallel to the base.

Swivelably mounted on the third section of the second rod is a thread conditioning module that includes a module support plate that has a pair of opposite sides, a female aperture on one of those sides into which a part of the third rod section projects to form a swivelable mounting for the conditioning module. On the remaining side of the support plate there are mounted a dual purpose pad and a pair of thread guides, one on each side of the pad, for guiding thread into engaging sliding contact with a surface of the pad to ensure continuous thread contact therewith to tension and/or lubricate the thread.

OBJECTS AND FEATURES OF THE INVENTION

It is one general object of the invention to improve thread conditioning devices.

It is yet another object of the invention to simplify such thread conditioning devices.

It is still another object of the invention to reduce costs for manufacturing such thread conditioning devices.

It is one further object of the invention to enhance versatility of such thread conditioning devices.

Accordingly, in accordance with one feature of the invention, simple and inexpensive cylindrical rods are employed and bent into desired shapes, thus facilitating manufacture and reducing cost.

In accordance with another feature of the invention, a part of one of the rods is employed for mounting one or more thread spools, and provision is made for retaining such spool or spools in the desired position through the use of slip-on frictionally engaging resilient washers thus simplifying use.

In accordance with yet another feature of the invention, a part of the other of the rods is employed for swivelable mounting of a conditioning module, and a pair of inexpensive thread guides made of conventional wire is disposed on opposite ends of a thread engagement pad thus simplifying construction, reducing cost and facilitating use.

These and other objects and features of the invention will be apparent from the following description, by way of example of a preferred embodiment, with reference to the drawing.

DESCRIPTION OF A PREFERRED EMBODIMENT

Figure 1:
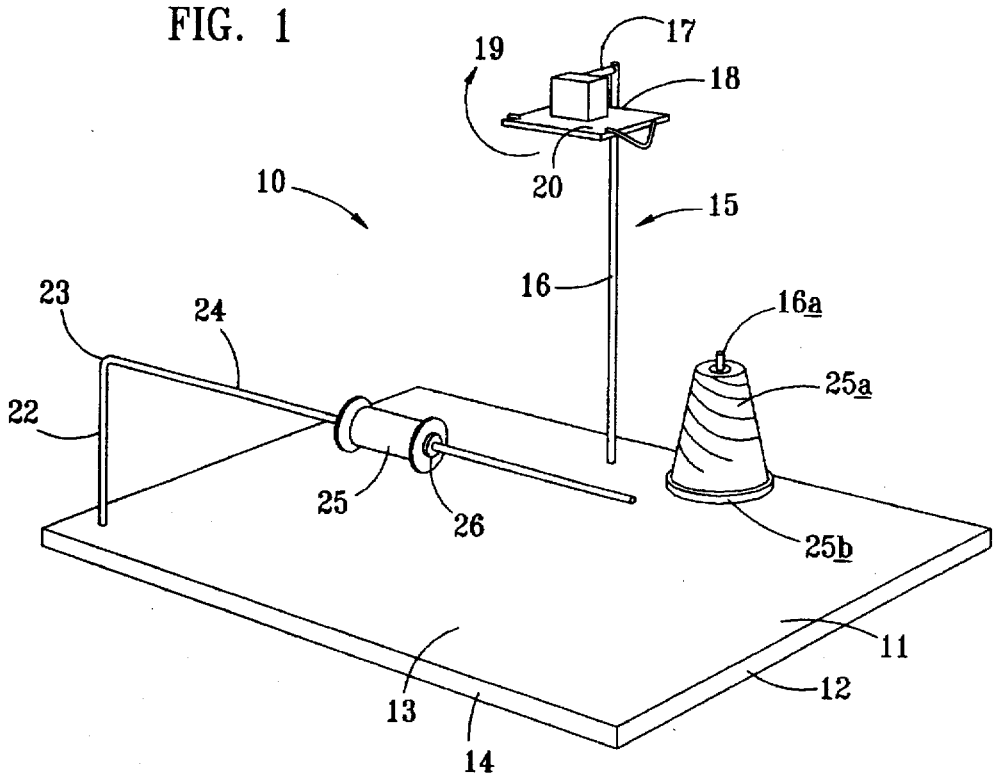
FIG. 1 is a perspective view depicting an improved thread conditioning device according to the invention.

Now turning to the drawing, and more particularly FIG. 1 thereof, it illustrates a thread conditioning device 10 according to the invention. There, it will be observed, are baseplate 11 which is of a thickness 12 sufficient to provide weight to stabilize the device. Baseplate 11 contains two major parallel surfaces 13 and 14, surface 14 lying on the underside of baseplate 11 and being identified at its edge as shown. Extending upwardly essentially at right angles to the planes of surfaces 13 and 14 is upstanding member 15 having a first essentially vertical section 16, a second section 17 essentially at right angles to section 16, and a third section 18 essentially at right angles to both sections 16 and 17. The height to which section 16 projects above surface 13 may be made adjustable through the provision of an extended threaded portion at its base and conventional adjustable nuts mounted on such extended threaded portion. It should also be observed that although in the interest of simplicity and economy, section 16 is illustrated as an integral member, it could be made multisectioned and telescoping in accordance with conventional techniques. As denoted by curved arrow 19, there is swivelably mounted on a cylindrical surface of section 18 a thread conditioning module 20 which is shown in more detail in FIGS. 2–5.

Also mounted on baseplate 11 and extending upwardly therefrom is a cylindrical rod 22 bent at essentially 90 degrees at bend 23 to form an essentially horizontally extending portion 24 adapted for loose mounting thereupon of thread spool 25. As is known to those skilled in the art, conventional thread spools include a central axially extending cylindrically shaped aperture therethrough for the purpose of mounting on spool supports. However, in order to conveniently retain spool 25 in a desired adjustable location on rod portion 24 while retaining its ability to freely rotate, a pair of resilient washers are force fit and frictionally engage surfaces of cylindrical rod portion 24. One of these washers is preferably disposed at one end of the spool 25, and the other (as shown at 26) is disposed at the other end.

Provision is also made for another upstanding member optional vertical mounting rod **16*a* on which a conventional thread spool (shown as cone 25*a*) may be mounted. Provision is also optionally made for including a conventional turntable 25*b* at the base of rod 16*a*** to facilitate spooling of thread from the cone. It will thus be seen that the assembly is adapted for handling threads from a plurality of different spools.

Figure 2:
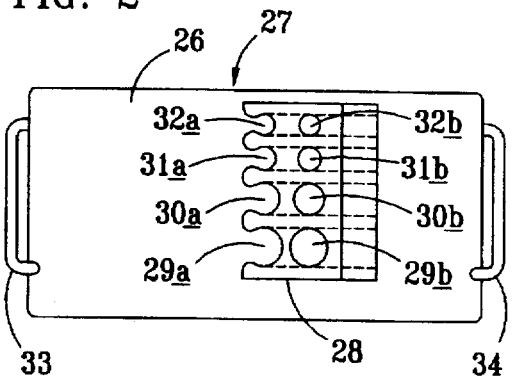
FIG. 2 is a top view of the conditioning module of FIG. 1.
Figure 5:
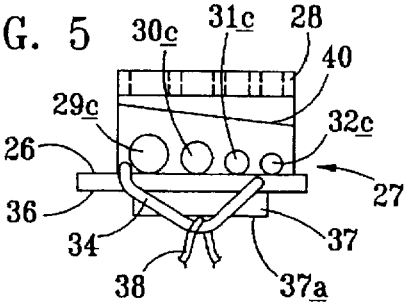
FIG. 5 is an end view of the conditioning module of FIGS. 1–4.

Now turning to FIG. 2, it will be seen to depict a top view of the thread conditioning module 20 of FIG. 1. There, in FIG. 2 are seen an upper side 26 of module support plate 27. Attached to upper side 26 is a connector part 28 which includes four sets of circular recesses as shown which are adapted for mounting engagement in different orientations with cylindrical mounting rods of different diameters. The circular recesses of any one of the sets are of similar diameter. Thus for example an illustrative set is seen to comprise circular recesses **29*a*, 29*b* and 29*c* (FIG. 5). The remaining sets are identified as 30*a*, 30*b*, 30*c*; 31*a*, 31*b*, 31*c*; and 32*a*, 32*b* and 32*c*. Also shown in FIG. 2 are a pair of thread guides 33 and 34 which are more clearly shown in FIG. 5**.

As mentioned above, FIG. 3 is a bottom view of the conditioning module of FIGS. 1 and 2. There, in FIG. 3 is depicted lower side 36 of module support plate 27, the above-described thread guides 33 and 34, and a thread-engaging pad 37 which preferably may be of conventional spongy lubricant resistant material such as open cell polyurethane foam.

Figure 3:
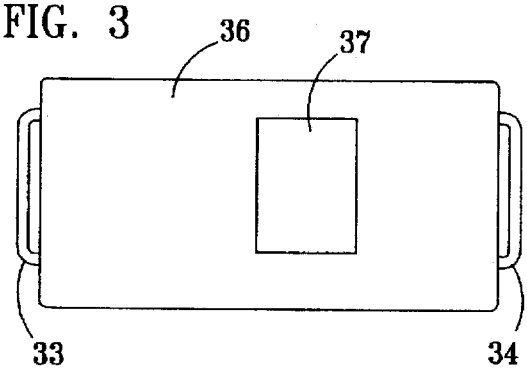
FIG. 3 is a bottom view of the conditioning module of FIGS. 1–2.
Figure 4:
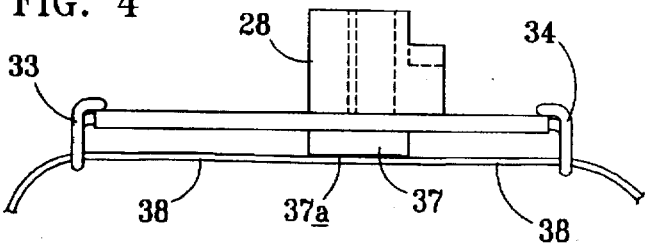
FIG. 4 is a side elevation view of the conditioning module of FIGS. 1–3.

Also as mentioned above, FIG. 4 is an elevation view of the conditioning module of FIGS. 1–3. There, connector part 28 is seen, the thread guides 33 and 34 are clearly shown, and a representative conventional thread 38 is seen passing through guides 33 and over an exposed thread-engaging surface **37*a* of pad 37**. Such thread may be of fiber (e.g., yarn) or a specialty type (e.g., metallic).

As mentioned above, FIG. 5 is an end view of the conditioning module 20 of FIG. 1. There, in FIG. 5, are seen connector part 28 with circular recesses **29*c*–32*c*, upper side 26 of module support plate 27, lower side 36 of module support plate 27, and thread-engaging pad 37 with surface 37*a* in contact with thread 38. Sloping surface 40 is provided merely to facilitate molding of part 28**.

As mentioned above, the thread-engaging surface **37*a* of pad 37** preferably is of a conventional spongy lubricant-resistant material such as open cell polyurethane foam which, when dry, imparts a controlled frictional drag on fiber thread as it passes thereover (thereby to impart controlled thread tensioning); but when lubricated with a conventional thread-lubricating lubricant, is effective to provide the desired degree of lubrication to threads of the type that need lubrication, e.g., metallic threads.

Although the inventions hereof have been described by way of a preferred embodiment, it will be evident that other adaptations and modifications may be employed without departing from the spirit and scope thereof. For example, an additional set of circular recesses could be added, and a small lubricant reservoir could be attached to module support plate 27 to replenish lubricant as it is transferred to thread 38.

The terms and expressions employed herein have been used as terms of description and not of limitation; and thus, there is no intent of excluding equivalents, but on the contrary it is intended to cover any and all equivalents that may be employed without departing from the spirit and scope of the invention.

What is claimed is:

1. A thread lubricating device comprising:

(a) a supporting baseplate;

(b) an upstanding member attached to said supporting baseplate, extending upwardly from said baseplate and having a plurality of sections:

(i) a first section having an upper extremity and extending essentially vertically upwardly from said baseplate for a majority length of said member, (ii) a second section extending from said upper extremity of said first section essentially at right angles thereto, and (iii) a third section extending from said second section essentially at right angles to said second section;

(c) a rod extending upwardly from said baseplate in spaced relation to said upstanding member, said rod being bent through about 90 degrees to form an essentially horizontal portion, said essentially horizontal portion for extending in loose fitting relation through an aperture in a thread spool to permit rotation of said thread spool when mounted on said essentially horizontal portion to discharge thread from said spool; and (d) a lubricating module swivelably attached to and supported by said third section of said upstanding member, said lubricating module comprising a module support plate having a pair of opposite sides, an aperture on one of said sides of said support plate for swiveling engagement with said third section and a lubricating pad attached to the other of said opposite sides of said support plate.

2. The thread conditioning device according to claim 1 in which said thread contacting pad is lubricated.

3. The thread conditioning device according to claim 1 in which said thread contacting pad includes a surface adapted for frictional engagement with said thread to tension said thread.

4. The thread conditioning device according to claim 1 in which said upstanding member is a rod.

5. The thread conditioning device according to claim 1 in which said third section of said upstanding member includes a cylindrical portion for swivelably mounting said conditioning module thereon.

6. The thread conditioning device according to claim 5 in which said upstanding member is a rod.

7. The thread conditioning device according to claim 6 in which said rod is cylindrical.

8. The thread conditioning device according to claim 7 wherein said conditioning module further includes a pair of thread guides in alignment with said thread contacting pad.

9. The thread conditioning device according to claim 1 wherein said conditioning module further includes a pair of thread guides in alignment with said thread contacting pad.

10. The thread conditioning device according to claim 9 in which said upstanding member is a rod.

11. The thread conditioning device according to claim 1 in which said supporting baseplate is rectangular in geometry and includes an upper planar surface and a vertically spaced lower planar surface essentially parallel with said upper planar surface.

12. The thread conditioning device according to claim 11 in which said second section of said upstanding member is essentially parallel with said upper planar surface of said supporting baseplate.

13. The thread conditioning device according to claim 12 in which said third section of said upstanding member is essentially parallel with said upper planar surface of said supporting baseplate.

14. The thread conditioning device according to claim 1 in which said third section of said upstanding member is essentially parallel with said upper planar surface of said supporting baseplate.

15. The thread conditioning device according to claim 1 further including, in combination, a first washer frictionally mounted on said essentially horizontal portion of said rod, a spool of thread positioned on said portion of said rod in abutting relationship to said first washer, and a second washer frictionally mounted on said essentially horizontal portion of said rod on an opposite side of said spool and in abutting relationship to said spool.

16. The thread conditioning device according to claim 1 further including another upstanding member having an essentially vertical section adapted for extending in loose fitting relation through an aperture in another thread spool to mount said another thread spool thereupon.

17. The thread conditioning device according to claim 16 further including within said baseplate a turntable, and wherein said another upstanding member is mounted on said turntable.

18. A thread conditioning device comprising:

(a) A supporting rectangular baseplate having an upper planar surface and a lower planar surface parallel to said upper planar surface;

(b) A first cylindrical rod attached to said supporting baseplate, extending upwardly from said baseplate and having:

(i) a first essentially vertical section with an upper extremity and extending upwardly from said baseplate for a majority length of said first cylindrical rod, (ii) a second essentially horizontal section extending from said upper extremity of said first section essentially at right angles to said first section, and (iii) a third essentially horizontal section extending from said second section essentially at right angles to said second section and essentially parallel to said upper planar surface, said third section having a first cylindrical portion adapted for swivelable mounting thereupon of a swivelable member;

(c) a second cylindrical rod extending upwardly from said baseplate in spaced relation to said first cylindrical rod, said second cylindrical rod being bent through about 90 degrees to form an essentially horizontal portion, said essentially horizontal portion being adapted for mounting a thread spool thereupon in loose fitting relationship to permit ready rotation of said thread spool when mounted on said essentially horizontal portion to discharge thread from said spool; and (d) a thread conditioning module swivelably attached to and supported by said third section of said first cylindrical rod, said conditioning module comprising a module support plate having a pair of opposite sides, an aperture on one of said sides of said support plate for swiveling engagement with said first cylindrical portion of said third section for swivelable mounting thereupon, a thread-engaging pad attached to the other of said opposite sides of said support plate for engaging said thread when discharged from said spool, and a pair of thread guides mounted on said support plate at opposite ends of said support plate and in alignment with said thread-engaging pad for guiding said thread over said thread-engaging pad when said thread is discharged from said spool.

19. The thread conditioning device according to claim 18 in which said thread engaging pad is lubricated.

20. The thread conditioning device according to claim 18 in which said thread engaging pad includes a surface adapted for frictional engagement with said thread to tension said thread.

* * * * *